United States Patent [19]

Blight et al.

[11] 4,135,842

[45] Jan. 23, 1979

[54] METHOD FOR TRANSPORTING AND ERECTING OFFSHORE TOWERS

[75] Inventors: Graham J. Blight; Hien T. Djie, both of Houston, Tex.

[73] Assignee: Brown & Root, Inc., Houston, Tex.

[21] Appl. No.: 869,315

[22] Filed: Jan. 13, 1978

[51] Int. Cl.[2] ..... E02D 25/00

[52] U.S. Cl. ..... 405/209; 114/264

[58] Field of Search ..... 61/87, 88, 96, 97; 114/258, 264, 266

[56] References Cited

U.S. PATENT DOCUMENTS

| | | | |
|---|---|---|---|
| 3,186,180 | 6/1965 | Swanlund et al. | 61/87 |
| 3,496,897 | 2/1970 | Pogonowski et al. | 61/97 X |
| 3,693,361 | 9/1972 | Koehler | 61/97 |
| 3,845,634 | 11/1974 | Rosenberg et al. | 61/97 |
| 3,937,027 | 2/1976 | Koehler et al. | 61/97 |

*Primary Examiner*—Mervin Stein
*Assistant Examiner*—David H. Corbin
*Attorney, Agent, or Firm*—Kenway & Jenney

[57] ABSTRACT

Method for transporting an offshore tower to a desired deepwater site and for erecting the tower to an upright position on the submarine floor at that site. Initially, the intended base end of the tower is supported on a first barge, and the intended top end is supported on a second barge. The barges are then towed to the deepwater site. At the site, the tower is launched by first mutually separating the barges through the application of substantially horizontal and oppositely directed forces, while maintaining one tower end substantially stationary with respect to its supporting barge, and permitting the other tower end to slide off of the other barge. Therefor, the other tower end is moved off of the other barge.

10 Claims, 26 Drawing Figures

Figure 1:
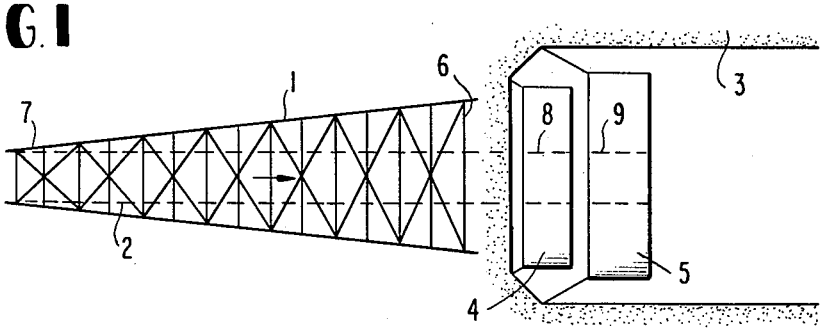

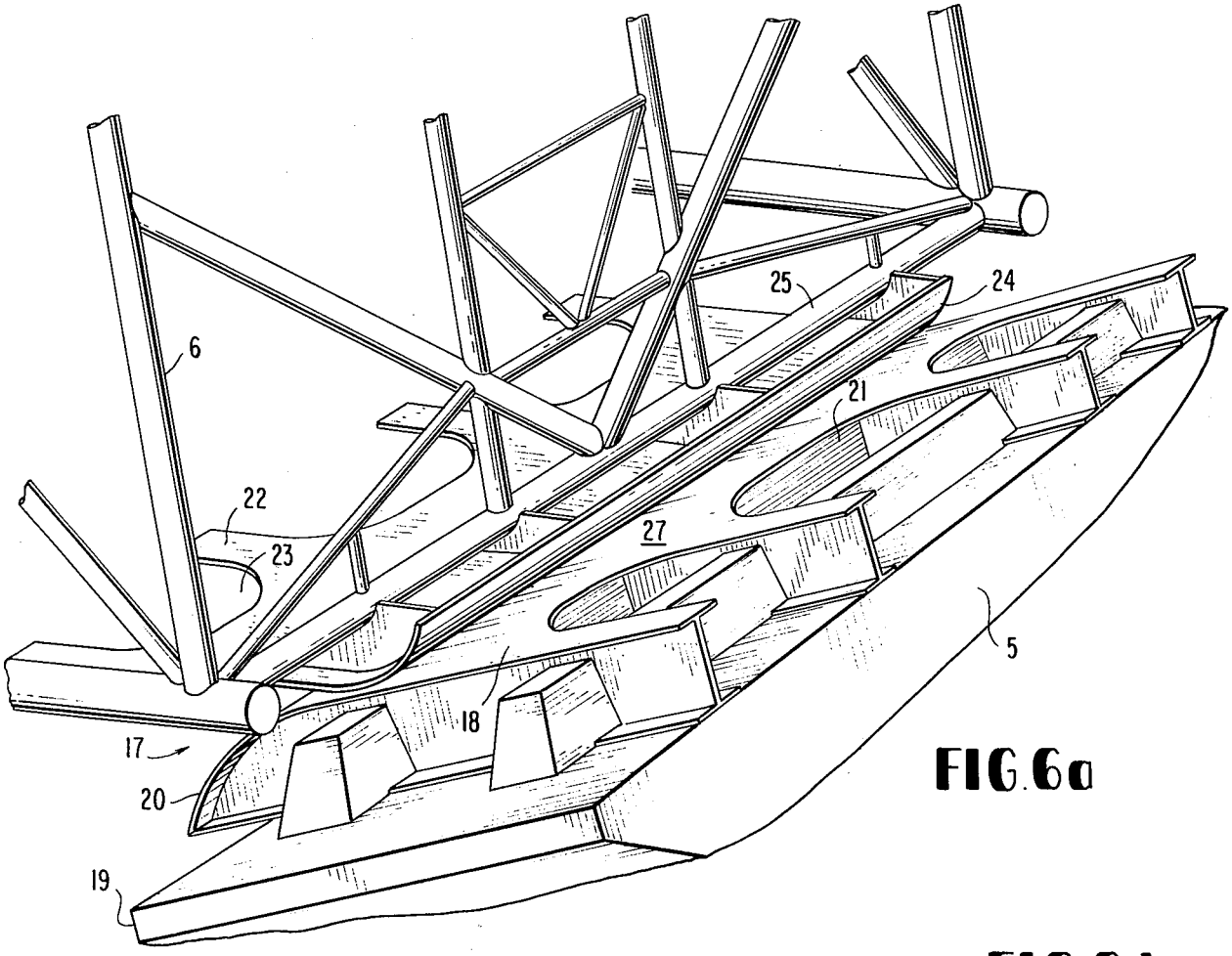
FIG. 6a
FIG. 6b
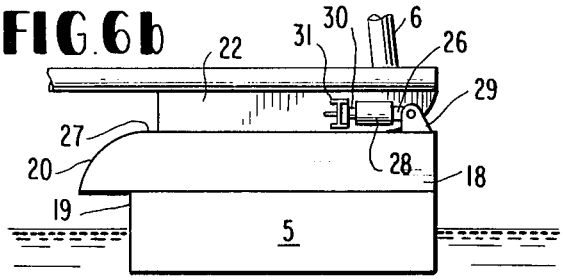
FIG. 6d
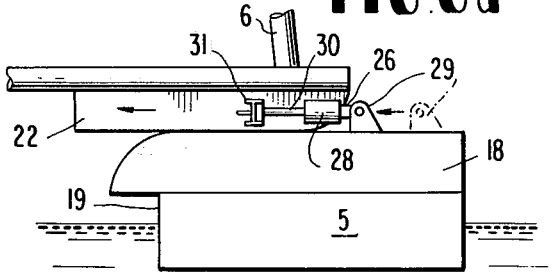
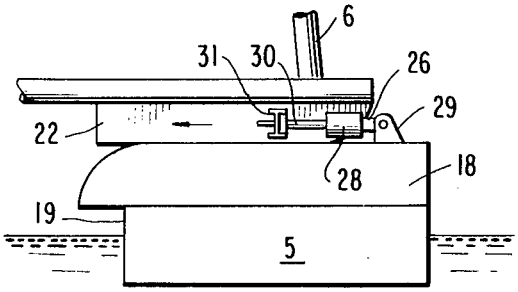
FIG. 6c
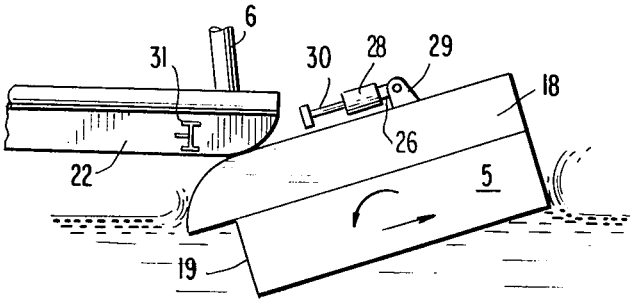
FIG. 6e

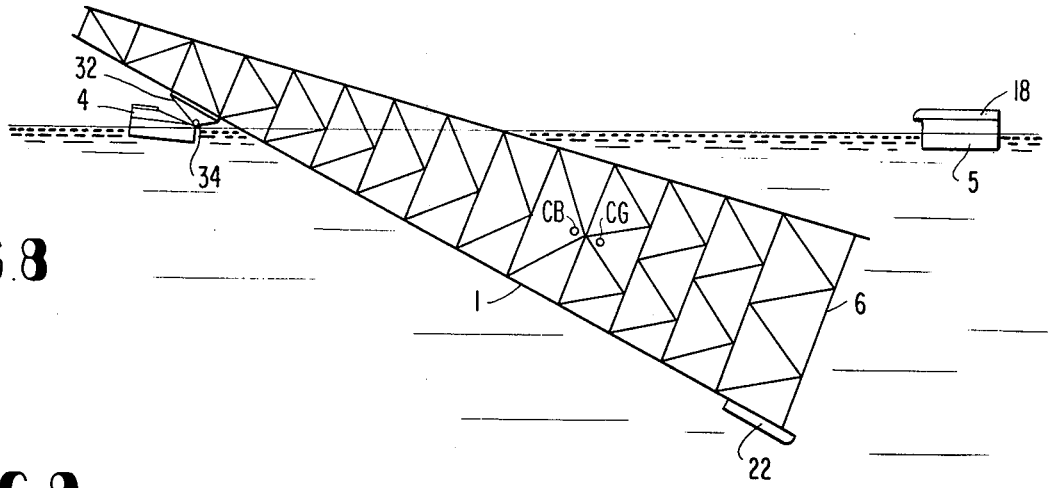
FIG. 8
FIG. 9
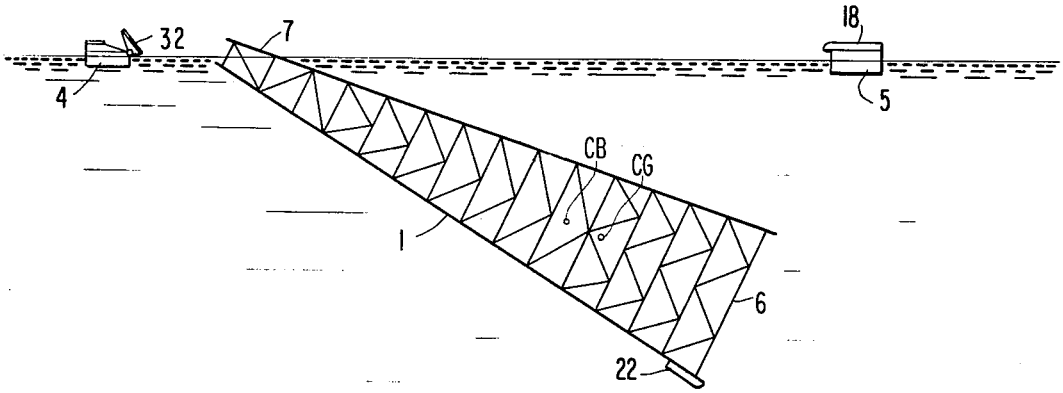
FIG. 10
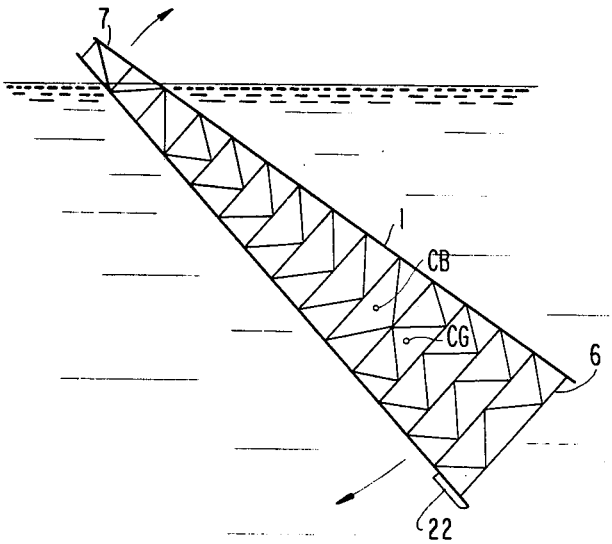
FIG. 11
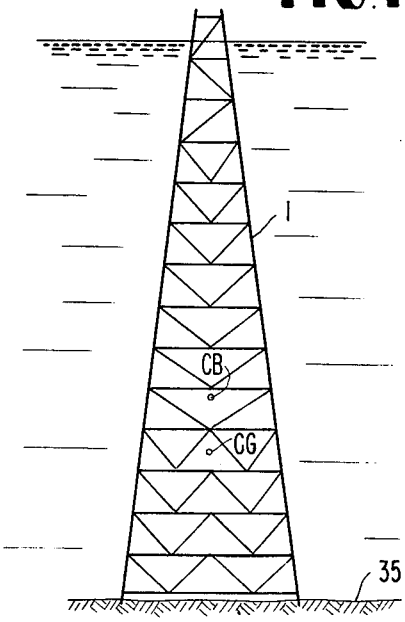

FIG. 13a
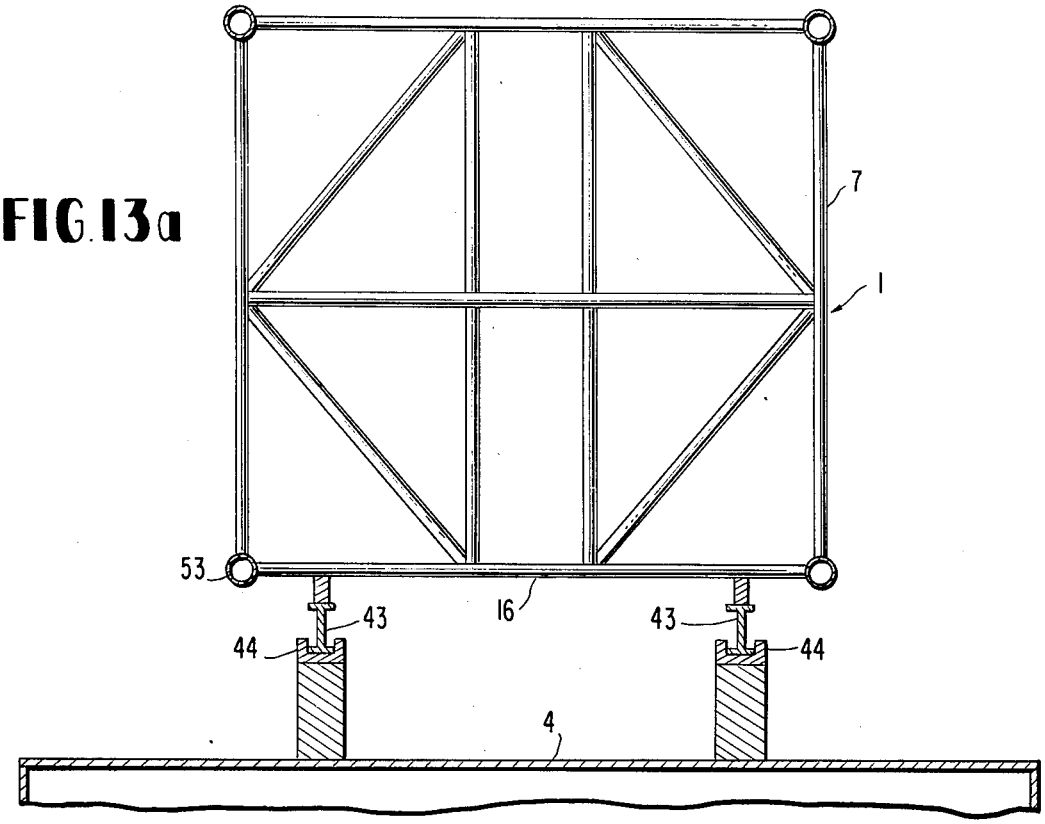
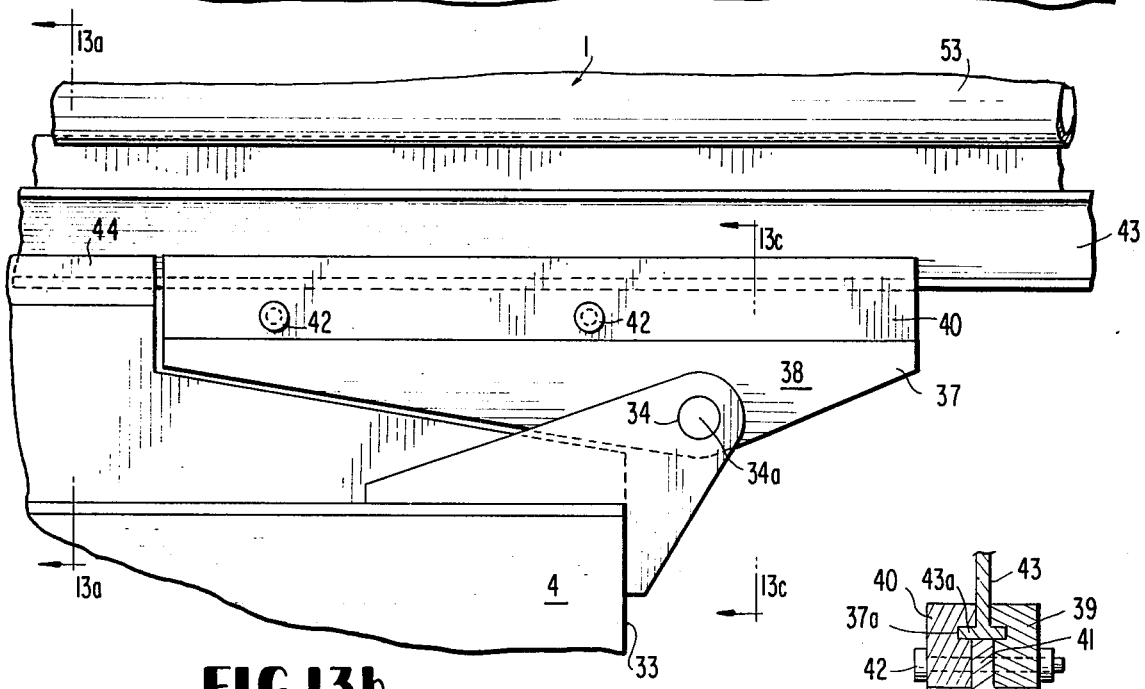
FIG. 13b
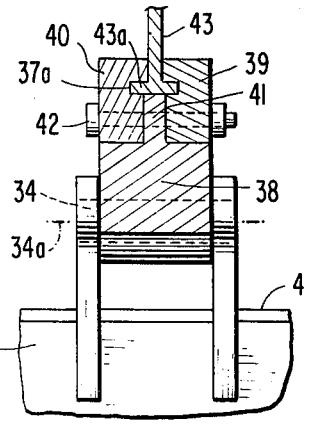
FIG. 13b

METHOD FOR TRANSPORTING AND ERECTING OFFSHORE TOWERS

BACKGROUND OF THE INVENTION

The invention relates generally to offshore oil and gas development, and more particularly to methods for installing an offshore tower in a deepwater location to facilitate such development.

Conventionally, such towers are called "jackets" and are fastened to submerged surface by means such as piling. Decks and other equipment are installed on the upper ends of such jackets. Such installations, when completed, provide platform means to support drilling, production, storage, and/or processing facilities.

In recent years, considerable research has been directed to the development of procedures and equipment for exploiting oil and gas deposits underlying large bodies of water. In the initial stages of offshore development, exploration and drilling and recovery operations were conducted in offshore waters in locations of relatively shallow water depths, such as from a few feet to 100 or more feet. Recently, however, considerable effort has been directed to exploration and site development in water depths ranging from a few hundred feet to 1,000 feet, or more. Examples of such deepwater oil fields may be found along the Pacific Coast continental shelf and the North Sea.

In order to exploit oil fields existing beneath such substantial depths of water, it is common practice to permanently install a jacket on a submerged surface, using fastening means such as piling. This jacket may be provided with a suitable top structure, or deck, as a base for supporting drilling, production, processing, and/or storage equipment. Such completed installations are often called platforms.

In order to exploit deepwater oil fields, it is necessary that jackets be of greater height than those used in shallow water oil fields. Furthermore, jackets for deepwater, open sea environments must also accommodate substantially greater stress than that generally encountered in shallow water operations. Consequently, suitable jackets for deep water installations are relatively large in both size and weight, and require correspondingly more effort in relation to both transportation to the deepwater site and erection of the jackets at the site.

Prior suggested approaches to the handling and erecting of large jackets offshore have involved techniques described in United States patents such as:

| Patent | Technique Disclosed |
|---|---|
| Hekkanen - 3,641,774 (1972) | Jacket segments assembled while floating |
| Guy et al - 3,859,806 (1975) | Jacket segments assembled while floating |
| Hauber et al - 3,315,473 (1967) | Jacket supported on twin barges which are submerged for jacket launching |
| Rosenberg et al - 3,845,634 (1974) | Jacket supported on rolling cylinders |
| Pogonowski et al - 3,496,897 (1970) | Jacket supported on outrigger of one barge and connected with pivot and socket of other barge |

In addition, a variety of other United States patent disclosures involve single and/or multiple barge launching systems and/or a variety of separable buoyancy systems. Such patents include, by way of example:

| Patent | Technique Disclosed |
|---|---|
| Kirby - 2,422,168 (1974) | Side launching slides on barge |
| Guenzel - 2,581,098 (1952) | Foldable platform with auxiliary buoyancy means |
| Sims - 3,036,438 (1968) | Caisson launched with auxiliary floats |
| Alcorn et al - 3,054,267 (1962) | Jacket launched with hinged barge section |
| Swanlund Jr. et al - 3,186,180 (1965) | Jacket launched from longitudinal ramp on barge |
| Steitle - 3,347,052 - (1969) | Separable, auxiliary buoyancy means |
| Lawrence - 3,633,369 (1972) | Auxiliary buoyancy means stripped away from upright jacket |
| Koehler - 3,693,361 (1972) | Auxiliary buoyancy units |
| Pogonowski et al - 3,708,985 (1973) | Platform monopod with articulated buoyancy units |
| Koehler - 3,815,371 (1974) | Auxiliary buoyancy |
| Crout et al - 3,823,564 (1974) | Detachable buoyancy raft |
| Koehler et al - 3,859,804 (1975) | Detachable buoyancy raft with auxiliary buoyancy means |
| Koehler et al - 3,937,027 (1976) | Side launching pivot on barge for jacket |

Prior proposals such as those noted above either do not lend themselves to the handling of large jackets with both economy and reliability and efficiency, or require special, often large, flotation equipment, or entail quite complex jacket installation operations.

OBJECTS AND SUMMARY OF THE PRESENT INVENTION

In light of the foregoing, it is a general object of the present invention to provide a novel and improved method for transporting and erecting an assembled offshore tower structure jacket at a deepwater site.

It is a particular object of the present invention to provide a novel method for launching an assembled tower structure jacket wherein the tower structure (i.e. jacket) is towed to an offshore site by a pair of barges, and slidably launched therefrom to a position between the original barge locations.

It is a further object of the invention to enable the basic objects, noted above, to be accomplished while utilizing generally conventional barge structures, thereby avoiding the necessity of employing unduly complex or large flotation equipment.

In accomplishing such basic objects of the invention, a method is presented for transporting an offshore tower, (i.e. jacket) to an offshore site and erecting this tower to a generally upright configuration, supported on a submerged surface.

Basic aspects of the method invention reside in a technique wherein one end of a tower is supported on a first barge, with the other end of the tower being supported on a second barge. The barges, thus supporting the tower, are towed to an offshore site.

At the offshore site, the tower is launched from the barges by:

1. Mutually separating the first and second barges by applying substantially horizontal and oppositely directed forces to the first barge and tower;
2. Slidably displacing the one tower end and the first barge in response to such separating, whereby the one tower end slides across the first barge into the water, while maintaining the other tower end supported on the second barge;
3. Causing the other end of the tower to be displaced across the second barge to the side thereof; and 4. Separating the other tower end from the second barge.

During the launching, as above described, the first and second barges are maintained substantially upright, albeit some barge tilting may well occur, possibly up to as much as 35° or more. Such tilting or heeling is a natural consequence of the dynamics of the system and will not cause overturning of the barges.

The tower, while separated from at least the first barge, is caused to settle to an upright position on a submerged surface where tower anchoring may be effected. The completion of the overall platform may then be effected through deck installation, etc.

Other independently significant facets of the invention, practiced in the context of the basic method invention noted above, reside in method facets which will now be delineated.

In one such method facet, the tower includes a relatively large base end, comprising the one tower end noted above. This tower also includes a relatively small top end, comprising the other tower end noted above. The barge, supporting the relatively small tower end is towed by vessel means in order to effect the towing operation noted above in connection with the basic method invention. During the slidable displacing of the relatively large tower end and the first barge, the relatively small tower end is pivoted upwardly away from and across the second barge so as to become displaced relative thereto. During the towing noted above, the tower is supported on the first and second barges with its longitudinal axis extending transversely of the longitudinal axes of the two barges.

Another independently significant method facet of the invention entails the basic method noted above wherein at least one of the one and other ends of the tower is at least in part supported on its supporting barge by pivotable support means. Such pivotable support means is pivotably mounted on the supporting barge and slidably supports the aforesaid one of the tower ends. During the launching of the tower, the pivotable support means, while slidably supporting the above-noted one of the ends of the tower, pivots about a side of the supporting barge so as to pivot the aforesaid one tower end away from and across the supporting barge and toward the other of the barges. In addition, during the launching, the aforesaid one of the tower ends undergoes sliding movement relative to and across the pivotable support means.

In another facet of the method invention, entailing the basic method context earlier noted, at least one of the tower ends is at least in part supported on its supporting barge by slide means. Such slide means would be carried by the tower and be slidably resting on skid means carried by the supporting barge. During the launching of the tower, the slide means, carried by this one of the two tower ends, slides off of the skid means across one side of the supporting barge, with the supporting barge moving away from the other barge in response to this "slide-off" operation.

A still further method facet of the invention, practiced in the context of the basic method earlier noted, entails a technique wherein at least one of the tower ends is at least in part supported on its supporting barge by pivotable support means. Such pivotable support means would be pivotably mounted on the supporting barge (i.e. the barge supporting this one of the two tower ends noted in the context of the basic method). During the tower launching, the pivotable support means, while supporting this one of the two tower ends, pivots about a side of the supporting barge so as to pivot this one of the two tower ends away from and across the supporting barge and toward the other barge. The pivotable support means, in this particular facet of the invention, would remain engaged (preferably slidably interlocked) with the tower while the tower pivots to a generally upright, buoyant condition, so as to permit the upright tower to be associated with the supporting barge in a generally pendulumlike manner.

As will be hereinafter described in both the specification and claims, the independently significant method facets of the invention, noted above, may be combined in various permutations and combinations so as to permit the invention to be practiced in a variety of formats.

Having described the basic method invention as well as independently significant method facets which may be utilized in conjunction with, or in the context of, the basic method invention, it now becomes appropriate to describe certain preferred embodiments of the invention with reference to appended drawings.

DRAWINGS

In describing certain presently preferred embodiments of the invention — by way of example but not by way of limitation — reference will be made to techniques illustrated in the appended drawings.

Figure 2:
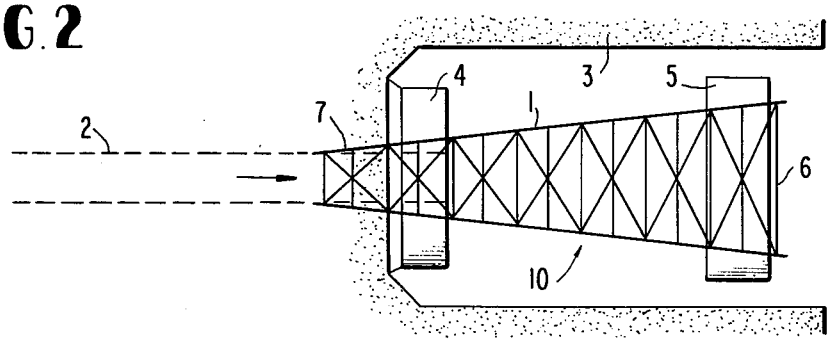
Figure 3:
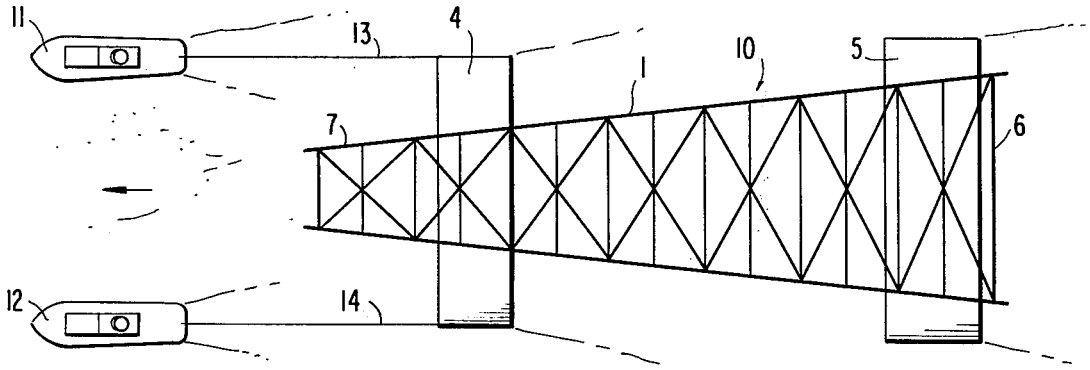
Figure 4:
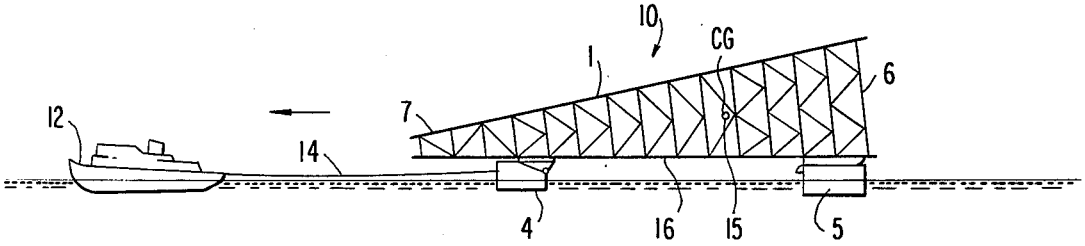
Figure 5:
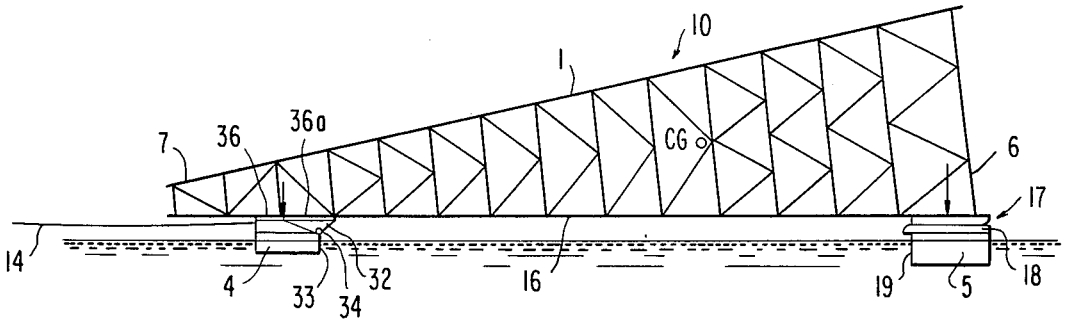
Figure 6:
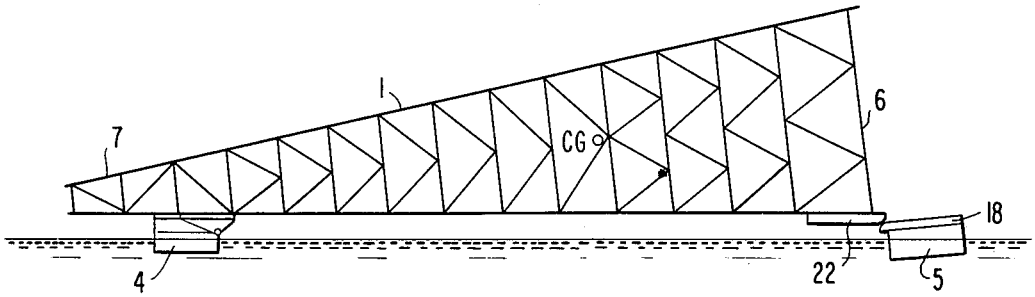
Figure 7:
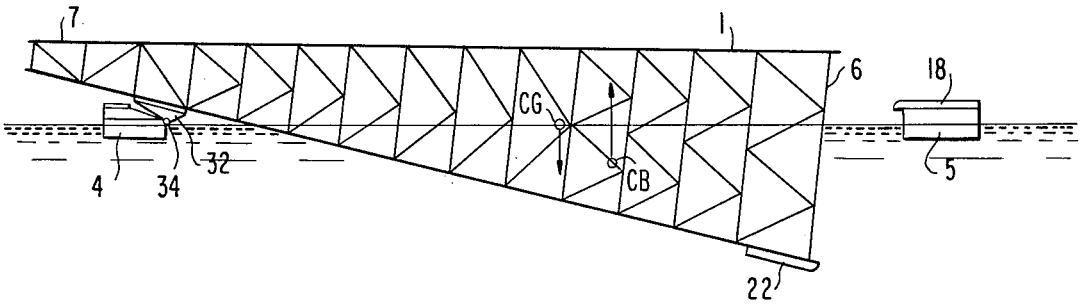
Figure 12:
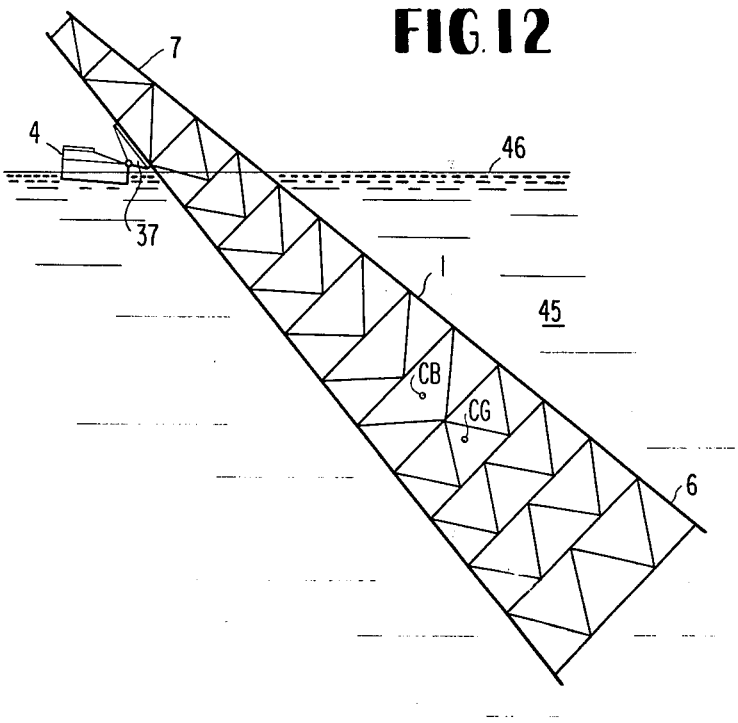
Figure 13:
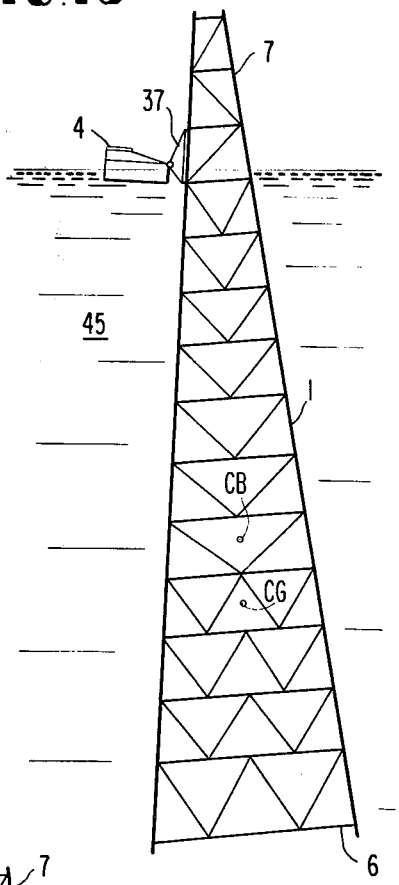
Figure 14:
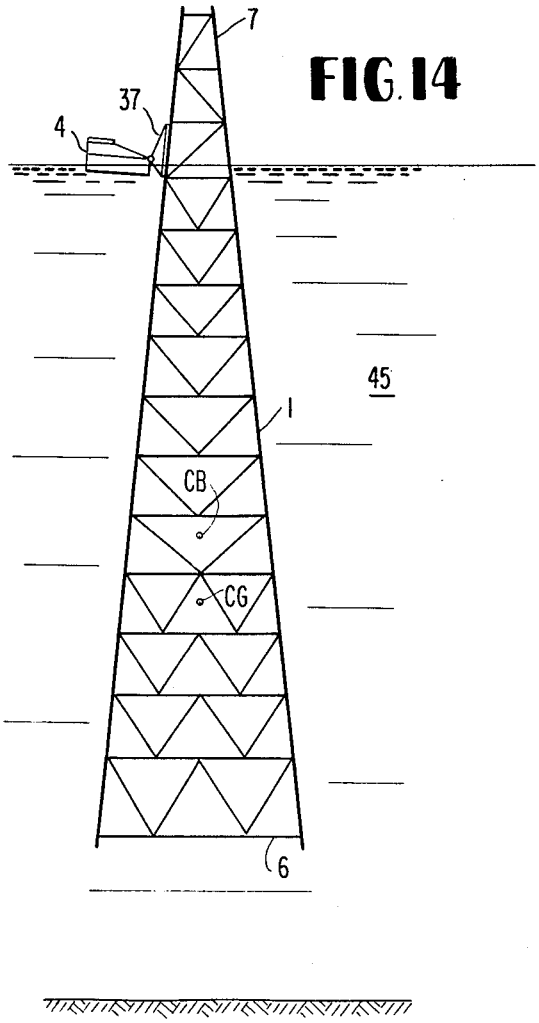
Figure 15:
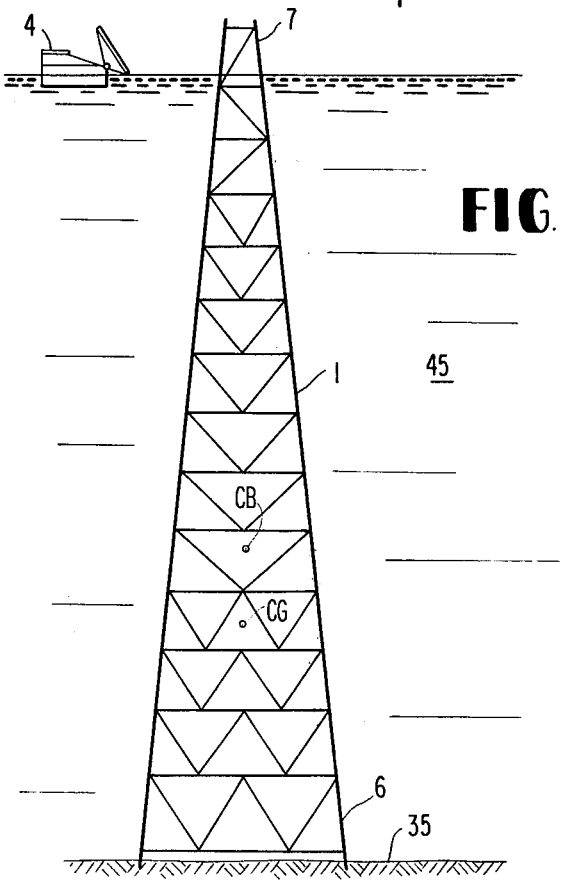
Figure 16:
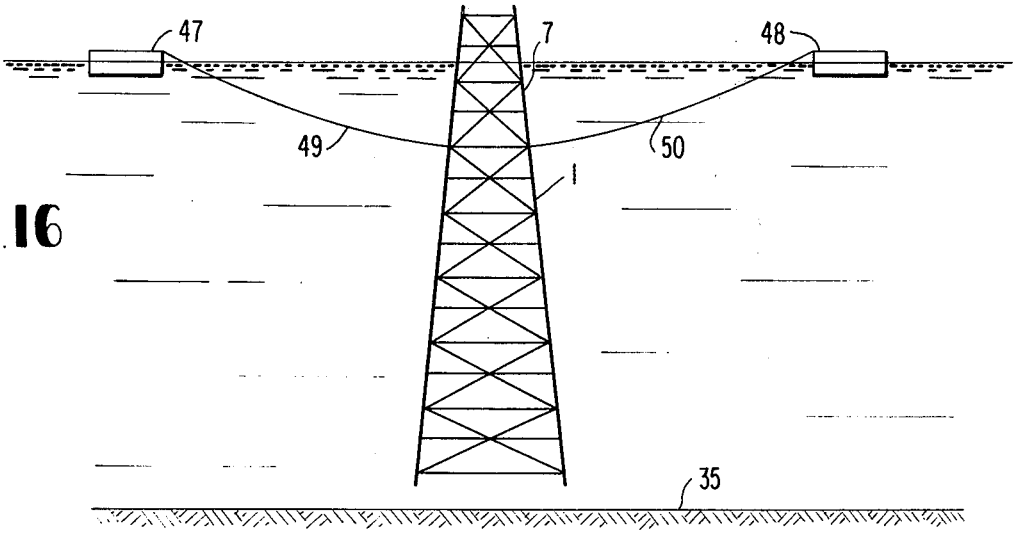
Figure 17:
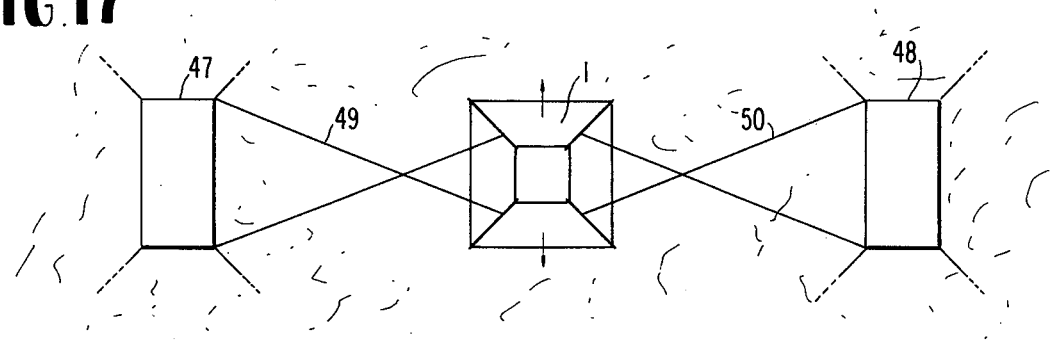
Figure 18:
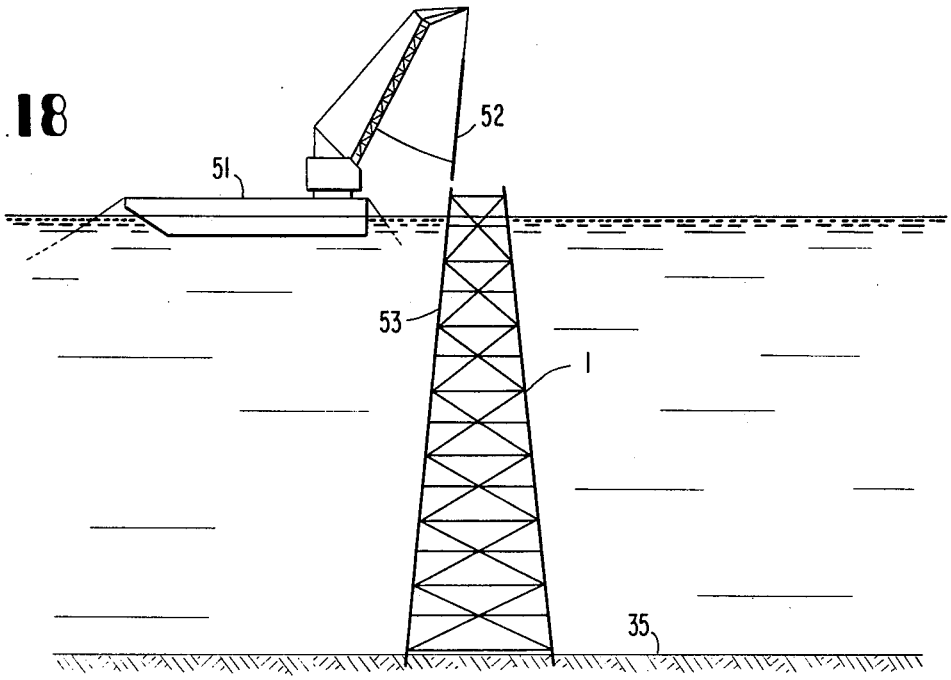

In these drawings:

FIG. 1 provides a reduced scale, top plan and schematic view of a construction facility which may be employed to facilitate the mounting of a jacket on two barges, illustrating the barges in position to receive the jackets;

FIG. 2 provides a reduced scale, top plan and schematic view of the FIG. 1 facility after the jacket has been skidded into position on top of the two barges, with its longitudinal axis extending transversely of the barge longitudinal axes, and with the barges supporting the base and top jacket ends;

FIG. 3 provides a top plan view of the aforesaid jacket, supported on barges, and being towed to a selected offshore site by tugs towing the barge supporting the smaller or top tower jacket end;

FIG. 4 provides a reduced scale, schematic, side elevational view of the FIG. 3 towing assembly;

FIG. 5 provides a side elevational view of the FIG. 3 assembly after it has arrived at a desired offshore site and jacket launching is to be commenced;

FIG. 6 illustrates, in side elevation, the commencement of launching of the jacket from the FIG. 5 assembly as a result of relative separation of the two barges, tending to move the barge supporting the base or large jacket end out from under the large jacket end itself;

FIG. 6(*a*) provides an enlarged, fragmentary, perspective view of a launching skid assembly which may be incorporated in the base of the tower featured in the invention embodiments depicted in FIGS. 5–11 and/or 12–15 so as to facilitate a skid type launching of the jacket base end from its associated or supporting barge;

FIG. 6(*b*) provides a schematic, fragmentary, side elevational representation of the FIG. 6(*a*) assembly, at a somewhat reduced scale, illustrating the disposition of skid and barge separating components during towing;

FIG. 6(*c*) schematically illustrates the FIG. 6(*b*) components during the commencement of the skidding or jacket base displacing operation;

FIG. 6(*d*) schematically illustrates the FIG. 6(*b*) skid assembly at the point where the barge and jacket base displacing mechanism has become, or is about to become, disengaged from the jacket base;

FIG. 6(*e*) schematically illustrates the FIG. 6(*b*) assemblage at the point in time where jacket base and supporting barge displacement have proceeded to the point where the jacket base has just about been skidded off of the side of the jacket base supporting barge facing the jacket top supporting barge;

FIG. 7, to the same scale as FIGS. 3–6, provides a side elevational, schematic view illustrating the jacket base after it has been skidded off of its supporting barge, with the jacket upper end still remaining engaged with the lead or tow barge;

FIG. 8 schematically, and in side elevation, illustrates the stage of the launching operation where, as a result of appropriate ballasting control, the jacket base has started to pivot downwardly through the water, with such downward pivoting movement being accompanied by sliding movement of the upper jacket end across and off of the top of the lead or tow barge;

FIG. 9 provides a somewhat reduced scale, schematic, side elevational view of the launching operation, showing the stage where the jacket has slid free of the lead or tow barge so as to be wholly separated from the two barges which supported the jacket during the towing operation;

FIG. 10 provides a somewhat reduced scale, side elevation and schematic view illustrating the freed jacket undergoing base ballasting so as to bring the jacket to an upright generally buoyant condition, still spaced from the submerged surface;

FIG. 11, in side elevation, schematically illustrates the jacket after ballasting of the upright jacket has been completed and it has moved downwardly through the water so as to come to rest on a supporting, submerged surface;

FIGS. 12, 13, 14, and 15 schematically illustrate, in side elevation, an alternative jacket launching technique, with FIG. 12 providing a side elevational and schematic view of a jacket after its base end has been freed from its supporting barge but wherein the upper jacket end is generally fixedly connected with a pivot mount supported on the lead or tow barge, and with FIG. 12 illustrating the jacket with the base end ballasted and pivoted downwardly into the water;

FIG. 13 provides a schematic, side elevational view of the jacket being launched by the alternative technique, after it has been ballasted to a nearly upright condition, and while remaining pivotably attached to the lead or tow barge;

FIG. 13(*a*) provides a relatively enlarged, transverse sectional view, viewed generally along section line 13*a*—13*a* of FIG. 13(*b*), and illustrating channel means operable to support slide rails connected with the side of the jacket which is supported on the barges;

FIG. 13(*b*) provides a relatively enlarged, side elevational view of the pendulum supporting pivot mount of FIG. 12, illustrating the manner in which a pivot mechanism is operable to generally slidably interlock with the support rails of the FIG. 12 jacket during the FIG. 12–14 pivotable movement of the jacket and subsequently permit freeing of the rails from the pivot mechanism in order to permit the jacket to be lowered to its final installed position;

FIG. 13(*c*) provides a transverse sectional view of the rail gripping pivot means of FIG. 13(*b*) as generally viewed along section line 13*c*—13*c* of FIG. 13(*b*);

FIG. 14 illustrates, in a schematic and side elevational format, the FIG. 12 embodiment wherein the jacket, supported in a pendulum-like manner by the pivot mount on the lead barge, has been ballasted to a fully upright condition in preparation for its vertical descent to the supporting submerged surface;

FIG. 15 schematically illustrates the jacket of FIG. 14 after it has been freed from its pendulum supporting pivot mount and allowed to descend, through appropriate ballast control, to the supporting submerged surface;

FIG. 16 provides a schematic, reduced scale, side elevational view, illustrating the manner in which service vessels may appropriately manipulate the upright and buoyant jacket to an appropriate position, subsequent to jacket launching, and where the jacket has been freed from its associated supporting barge;

FIG. 17 provides a top plan, schematic view of the FIG. 16, jacket manipulating assembly; and FIG. 18 schematically illustrates a service barge, provided with appropriate pile driving equipment, and being operated to drive piling through the jacket legs so as to anchor the jacket to its submerged base installation.

With basic illustrative aspects of the invention having been described with reference to the appended drawings, it is now appropriate to give further consideration, by way of written description, to details of the jacket handling technique of the present invention.

GENERAL DESCRIPTION

In describing the jacket launching method of the present invention, sequential aspects involved in overall jacket setting operations will be described, in relation to the appended drawings, as follows:

| Sequence Step | Illustrations |
|---|---|
| 1. Assembly of jacket on barges | FIGS. 1 and 2 |
| 2. Towing assembled jacket and barges to offshore site | FIGS. 3 and 4 |
| 3. First, preferred jacket launching technique of this invention | FIGS. 5 through 11 |
| 4. Second, preferred jacket launching technique of this invention | FIGS. 12 through 15 |
| 5. Jacket setting and anchoring | FIGS. 16 through 18 |

The overall approach to the discussion of the context of the invention having been delineated, it now becomes appropriate to give consideration to each of the steps tabulated above.

Assembly of Jacket and Support Barges

FIGS. 1 and 2 schematically illustrate a graving yard technique which may be employed to assemble the jacket and barges of the present invention.

As shown in FIG. 1, a jacket 1 is positioned on a skid or ramp means 2 and disposed adjacent a loading basin 3.

Loading basin 3 constitutes a contained body of water operable to communicate with a body of water leading to an offshore site where the jacket 1 is to be launched.

As shown in FIG. 1, a pair of barges 4 and 5 are disposed at the end of the loading basin 3 adjacent the skidway 2.

Jacket 1 may assume a variety of configurations, for example, jacket 1 may be generally square in cross-section and comprise an open type of frame work including longitudinal frame members or legs interconnected by transversely extending trusses and bracing.

Conventionally, jacket 1 will include a relatively large base end 6 and a relatively small (compared to the base) upper end 7. Base end 6 is adapted to rest upon a submerged offshore surface, with upper end 7 projecting above a water surface and operable to support a deck structure.

In the practice of the present invention, it is contemplated that jacket 1 may have a length (i.e. distance from base to top) on the order of 600 to 1,200 feet, or possibly more or less, depending upon anticipated water conditions at the site of installation. In any event, maximum advantages of the invention are derived in relation to deepwater installations.

Barges 4 and 5 may comprise generally conventionally sized barges having a width on the order of about 90 to 100 feet and a length of somewhere on the order of 300 to 400 feet or possibly more or less, depending upon appropriate circumstances.

As shown in FIG. 1, jacket 1 is laid on one side on the skid mechanism 2 so as to be skidable across the top of the barges 4 and 5, with the longitudinal axis of jacket 1 extending transversely of the longitudinal axes of the transversely disposed barges 4 and 5.

Each of barges 4 and 5 may be provided with appropriate, transversely extending, skid means or jacket side support means. Thus, barge 4 may be provided with a series of transversely extending skidways 8, generally aligned with the skid means 2, while barge 5 may be provided with similar skidways 9, aligned with the skidways 8 of barge 4.

With this arrangement, when the barge 1 is skidded off of the ground skidway 2, across barge 4, and onto the skidway means 9 of barge 5, the base end 6 of barge 1 may be secured by appropriate, detachable locking or tie-down means to the barge 5. Thereafter, outward skidding movement of jacket 1 (i.e. to the right as shown in FIG. 2) may continue (pushing barge 5 away from barge 4) until the upper end 7 of jacket 1 is brought into position over the barge 4. At this point, the upper end 7 of jacket 1 may be detachably secured to the upper surface of barge 4 by appropriate, detachable locking or tie-down means.

A variety of detachable locking or tie-down means may be employed for detachably securing the jacket 1 to the upper surfaces of the barges 4 and 5.

For example, detachable jacket securing means as featured in the above-noted Steitle et al U.S. Pat. No. 3,347,052 and/or Alcorn et al U.S. Pat. No. 3,054,267 and/or Crout et al U.S. Pat. No. 3,823,564 might be be employed, as well as a wide variety of other selectively actuatable engageable and detachable latching and/or securing mechanisms. In many instances, removable, welded tie-downs may be employed to secure jacket 1.

With the jacket 1 thus securely mounted on the barges 4 and 5, with its longitudinal axis extending transversely of the longitudinal axes of the transversely arranged barges, the towable jacket and barge assembly 10 may now be removed from the loading basin 3 and towed to a desired offshore site.

Towing of Jacket and Barge Assembly

FIGS. 3 and 4 schematically illustrate one preferred mode of towing of the jacket and barge assembly 10 to a desired offshore site.

As shown in FIG. 3 and 4, a pair of tugs 11 and 12 may be connected by appropriate tow line means 13 and 14 to the lead or tow barge 4. Under appropriate circumstances, more or less tugs or other vessels may be employed for the towing operations.

Lead or tow barge 4, as shown in FIGS. 1, 2, and 3, may be somewhat smaller than the aft or jacket base supporting barge 5.

With the arrangement shown in FIG. 3, the jacket 1 is supported with the smaller or upper jacket end (i.e. upper in the sense that end 7 will project above the water surface when installed) being the leading end of the jacket during the towing operation.

As shown in FIG. 4, the barge will be towed with its center of gravity 15 lying between the longitudinally spaced barges 4 and 5 (i.e. the barges are spaced longitudinally of the longitudinal axis of jacket 1).

As will be appreciated, with this towing arrangement, and with one side 16 of the jacket being supported directly on, or relatively close to, the upper surfaces of the barges 4 and 5, a high degree of stability is achieved for the barge towing operation. Lateral stability results from the lateral orientation of the barge, while longitudinal stability results from barge spacing.

Once the assembly 10 has been towed by tug means (i.e. one or more tugs) to the desired offshore site, launching of the jacket 1, freed from the barges 4 and 5, and erection of the freed jacket to an upright configuration, resting on a submerged offshore surface, may be effected.

At this point, the discussion will continue with reference to two presently preferred launching techniques which may be employed, it being recognized that several variations with respect to the disclosed techniques may be practiced and that the first described technique is deemed to be generally the most preferable.

First, Preferred Jacket Launching Technique of the Invention

FIGS. 5–11 sequentially illustrate steps involved in the first preferred technique for launching the jacket 1 to a condition freed from its associated and supporting towing barges 4 and 5, so as to permit the erection of the jacket 1 to a generally upright condition and its subsequent lowering to a submerged surface.

In this connection, FIGS. 6(*a*)–6(*e*) illustrate structural and manipulative details of an aft skid means 17 which may advantageously serve to facilitate skidding of the jacket base 6 free of the aft tow barge 5.

As shown in FIG. 6(*a*) (which corresponds generally to FIG. 6(*e*)), skid means 17 may comprise a skid table or skid means 18 extending generally longitudinally along one side 19 of barge 5, and preferably overhanging side 19 as illustrated in FIG. 6(*a*).

Skid table 18 may be provided with a downwardly curving jacket slide-off or discharge surface 20 projecting beyond barge side 19.

Skid table 18 may also be provided with one or more weight-reducing openings 21 operable to reduce the overall weight acting on barge 5.

Table 18 may also be provided with suitable friction-reducing means to facilitate sliding movement of jacket end 6 and/or with shock-absorbing support means and/or gimbal type jacket support means operable to stabilize the jacket end 6 during towing operations and minimize wave action induced stresses (torsional or otherwise oriented).

Jacket end 6 may be provided with a generally plate-like slide or skid shoe means 22 extending substantially coextensive with skid table means 18 during the towing operation. Where appropriate, and if desired, skid shoe means 22 may be provided with cut-out portions 23 operable to reduce the weight acting on barge 5 and/or may also be provided with friction-reducing means to facilitate sliding movement between table means 18 and skid shoe means 22.

Skid shoe means 22 may include an upwardly curving end 24, projecting beyond the outermost, transverse framing member 25 of jacket end 6 as shown generally in FIG. 6(*a*). The projecting nature of curved surface 24 relative to jacket end 6, coupled with the projecting nature of the surface 20 relative to barge side 19, would tend to insure that the jacket end 6 would properly "clear"the barge side 19 during the jacket sliding-off operation.

Although not shown in FIGS. 5–11 or FIG. 6(*a*) for purposes of illustrative convenience, but as shown in FIGS. 6(*a*)–6(*e*), barge 5 may be provided with appropriate hydraulic pusher means 26. Such pusher means are operable to induce relative separation of the barges 4 and 5 so as to slide the jacket end 6 off the barge 5, by sliding the jacket end 6 across the top of the barge 5 as defined by the top surface means 27 of the skid table 18.

As shown schematically in FIG. 6(*b*), hydraulic pusher means may comprise one or more hydraulic piston and cylinder assemblies 26, each including a cylinder 28 connected with barge 5 by possibly translatable mounting means 29. A piston rod 30 may project from cylinder 28 and be detachably engaged with bracket or mounting means 31 carried by jacket end 6 (i.e. possibly connected with skid shoe means 22). Bracket 29 may be mounted on barge 5 for translation to the left, as shown in FIG. 6(*b*) by means such as powered screw drive means, etc.

As will be subsequently described, and as will be apparent from the foregoing description, extension of the piston rod 30, out of cylinder 28 and/or translation of mounting 29 to the left as shown in FIGS. 6(*c*) and 6(*d*), will displace the barge 5 to the right as shown in FIG. 5, so as to induce relative separation of the barges 4 and 5 and cause the jacket end 6 to slide across the top of barge 5 and into water on the side of barge 5 facing barge 4, i.e. side 19.

Preferably, the upper jacket end 7 may be supported on the lead or tow barge 4 on skidway means 8 (schematically shown in FIG. 1) and launched from this skidway means. Alternatively, a pivot shoe arrangement may be employed to launch the top of jacket 7 as set forth in the aforesaid Koehler et al U.S. Pat. No. 3,937,027.

In general, by way of simplifying operations, it is believed to be better to launch the top end 7 of jacket 1 from the lead barge 4 by way of two or more conventional, fixed skidways or rails, mounted on the top of barge 4. However, where pivot shoes are employed, certain load distributing and clearance advantages may be achieved during launching, as described in the aforesaid Koehler et al U.S. Pat. No. 3,937,027.

Thus, as shown in FIG. 5 in a schematic sense, upper jacket end 7 may be supported by pivot shoe means 32, pivotably connected with side means 33 of barge 4 by pivot means 34. Pivot means 34 would have axis means extending longitudinally of the barge 4, generally along the barge side 33.

As shown in FIG. 5, during the normal towing operation, the upper jacket end 7 would rest on the upper pivot shoe surface means 36a, as well as on rail means or support means 36 (which may comprise skid means 8) fixedly connected with the upper surface of barge 4 and defining a general continuation of the pivot shoe upper surface means 36*a*.

If desired, fixed skidway means 8 could be defined in essence, by locking pivot shoe means 32 against pivotable movement so as to provide fixed skidway means or rails overhanging the side 33 of barge 4, and extending transversely across the top of barge 4. If desired, the jacket launching ends of skidway means 8 (or pivot shoe means 32) may be downwardly curved in order to provide a smooth launching action.

As earlier noted, selectively detachable connecting or tie-down means may be employed for connecting the underside 16 of the jacket 1 to the upper surface means 36 and 36*a* of barge means 4, while similar selectively actuatable detachable connecting or tie-down means may be employed for connecting the jacket underside 16 with the skid table 18 of barge means 5.

When the jacket and barge assembly 10 is under tow, as in FIG. 3, such selectively detachable connecting means would prevent relative separation of the jacket and barges and stabilize assembly 10. However, when jacket launching is to be effected, such detachable connecting means would be released, at appropriate times during the launching sequence, to permit the relative jacket and barge movements hereinafter described to be safely and controllably effected.

With basic elements of the jacket supporting and launching equipment having been described, the jacket launching sequence will now be discussed with relation to FIGS. 5–11.

FIG. 5 illustrates the assembly 10, disposed at the desired launching site, with the detachable connecting means securing the jacket 1 to the barges 4 and 5 having been released.

With the detachable connecting or latching means released, the hydraulic pushing mechanism 26 may be actuated so as to horizontally extend the piston or pushing rod 30, as shown in FIG. 6(*c*). Such extension and/or horizontal translation of cylinder mounting means 29, would serve to displace the barge 5 to the right, as shown sequentially in FIGS. 6(*b*) through 6(*e*) so as to induce separation of the barges 4 and 5 and tend to push the jacket end 6 to the left, as shown in FIG. 6, and off of the top of the barge 5, as shown in FIG. 7. During such generally horizontal pushing or displacing of the jacket end 6, the barge 5 may undergo some heeling, as schematically shown in FIG. 6 but would remain in a generally upright condition.

As shown in FIG. 6(*d*), at some point in time during the pushing operation, deemed appropriate, the piston rod means 30 may become disengaged from the bracket means 31, if it was originally attached thereto. Such disengagement could result automatically as a result of movement of the jacket end 6 across the top surface of the heeling barge 5 triggering a release device, or could result through bracket 31 merely moving free of abutting engagement with piston rod 30.

In any event, once sufficient pushing action had been effected by the mechanism 26, the jacket end 6 would move free of the barge 5, i.e. off of the barge side 19, as generally depicted in FIG. 7. As will be appreciated by reference to FIGS. 6(*e*) and 7, during the final stages of the sliding off movement of the jacket end 6, and the reactive forces existing between the jacket end 6 and the barge 5 would tend to heel barge 5 and displace the barge 5 to the right as shown in FIGS. 6(*e*) and 7 so as to ensure a safe separation distance between the jacket end 6 and the barge 5 during the final phase of the jacket separation from the barge 5. This self generating heeling action thus enhances jacket and barge separation but stops short of barge overturning. It will be appreciated that the dynamic heeling forces acting on the barge 5 are transient in nature during the sliding off of the jacket end and that the resisting hydrodynamic damping forces affecting barge movement operate to prevent barge capsizing or overturning.

As shown in FIG. 7, once the jacket end 6 is moved free of the barge 5, it may be in a sufficiently buoyant condition so as to come to rest in the generally horizontally extending condition. This position of equilibrium is obtained when the moment of weight and moment of buoyancy about pivot 34 are equal, although the center of buoyancy may be further from the barge 4 than the center of gravity. This condition will ensure the generally horizontally extending floating configuratin of the jacket 1 subsequent to its launching or separation from the barge 5.

As will be noted with reference to FIG. 7, when the jacket end 6 drops free of the barge 5, the upper jacket end 7 (and its associated and supporting pivot shoe means 32, if employed) may pivot generally about the barge side 33 (about pivot means 34 if pivot shoe means 32 is employed) so as to cause the upper jacket end 7 to start to pivot across the top of the barge 4 and toward the barge 5. Some sliding movement of the jacket end 7 to the right, across barge side 33, as shown in FIG. 7 may also occur.

By appropriately ballasting or flooding the normal buoyancy compartments contained in the base 6 of the jacket 1 (see, for example, Crout et al U.S. Pat. No. 3,823,564 and Koehler et al, U.S. Pat. No. 3,859,804), the jacket base 6 will be caused to rotate clockwise about pivot means 34, in the manner generally depicted in FIG. 8, so as to tend the jacket 1 to commence to assume an upright configuration. Such movement may be accompanied by sliding movement of jacket top 7 across skidway means 8 (or shoes 32).

Such flooding of ballast chambers in the base of jacket 1 may occur automatically through appropriate flood valve means of may be remotely or operator controlled as generally described in the aforenoted Koehler et al U.S. Pat. No. 3,859,804 and similar patents.

The result of such flooding will produce a shift of the center of buoyancy to the left, with reference to the arrangement of the centers as shown in FIG. 7 and a commensurate increase of the weight moment over the buoyancy moment. Provided that the moment of weight about the pivot is maintained greater than the moment of buoyancy, then the jacket will progressively rotate to an upright position as ballasting continues so as to ensure that the center of buoyancy will lie above the center of gravity during the final stages of the jacket setting operation. This shift of the center of buoyancy to the left of the center of gravity with reference to FIG. 7, leads to the relationship between these centers as depicted schematically in FIG. 8 and is a feature which will stabilize the upright orientation of jacket 1. As will be understood, the center of buoyancy may not move to a position above the center of gravity until the jacket 1 actually moves free of barge 4.

As ballasting of the lower jacket end 6 continues, the upper jacket end 7 will move free of the barge 4, as shown in FIG. 9, so as to cause the jacket 1 to now be free of or separated from each of the barges 4 and 5. Such movement may entail the jacket end sliding off of skidway means 8 (or pivot shoe means 32). During the final sliding movement of the jacket end 7 off of the sliding means 8 or pivot shoe means 32, the reactive forces between the jacket 1 and barge 4 may tend to cause the barge 4 to be displaced to the left, as shown in FIG. 9. Such displacement, of course, will desirably ensure a safety separation distance between the upper jacket end 7 and the barge 4 during the final phases of the jacket launching operation. Conceivably, however, the jacket 1 may undergo sufficient rotation so as to move top 7 away from barge 4 before such a full, "slide-off" launch is completed.

Continued ballasting or flooding of the buoyancy chambers of the lower end 6 of the jacket 1, as shown in FIG. 10, will tend to cause the jacket 1 to pivot to a generally upright and floating condition in the water, with still further continued ballasting causing the jacket 1 to settle to the submerged surface 35 in a generally upright configuration, as schematically depicted in FIG. 11.

Second, Preferred Launching Technique of the Invention

FIGS. 12–15 illustrate a preferred alternative technique for effecting the launching of the jacket 1.

Before commencing the discussion of the sequence involved in jacket launching as entailed in this alternative technique, reference will first be made to FIGS. 13(*a*)–13(*c*) in connection with a modified pivot shoe structure, i.e. a modified form of the pivot shoe means featured in the aforesaid Koehler et al U.S. Pat. No. 3,937,027.

As shown in FIG. 13(*b*) a modified pivot shoe means 37 is supported on side 33 of barge 4 by pivot means 34.

Pivot shoe means 37, as schematically shown in FIGS. 13(*b*) and 13(*c*), may comprise a plurality of rocker plates 38, each mounted for pivotal movement abot the pivot axis 34(*a*) of pivot means 34. In this connection, as was noted earlier in connection with the discussion of FIG. 5, it will be appreciated that pivot means 34 provides a pivot axis 34(*a*) extending longitudinally along the side 33 of barge 4, preferably disposed somewhat outboard of side 33 as illustrated in FIG. 13(*b*).

Pivot shoe means 37 differs somewhat from the pivot shoe means featured in the aforesaid Koehler et al U.S. Pat. No. 3,937,027 in that pivot shoe means 37 is operable to perform, for a limited period of time, a retaining action with respect to the jacket 1.

As illustrated in FIGS. 13(*b*) and 13(*c*), this retaining action may be provided by transversely separable retaining segments 39 and 40 which may be secured to an upright web portion 41 of rocker plate 38 by selectively operable, transverse fastening means 42.

Fastening means 42 may extend transversely through apertured portions of retaining segments 39 and 40 and through apertured portions of mounting web 41.

Such fastening means 42 may be manually or remotely actuable so as to releasably secure retaining segments 39 and 40 to mounting web means, defining an inverted "T"socket. This socket 37*a* may slidably and retainingly engage a lower flange 43*a* of a rail means 43 ("I"beam) which is connected with the underside 16 of jacket 1. (It here being understood that jacket top 7 would be retained on barge 4 by a plurality of such rail and pivot shoe arrangements).

As shown in FIGS. 13(*a*) and 13(*b*) each of the plurality of rail means 43 carried by the underside 16 of jacket 1 may be operable to rest in a channel means 44 disposed to the left of pivot shoe means 37, as viewed in FIG. 13(*b*). Thus, each "I" beam rail 43 may be operable to be supported by resting in part in a channel means 44 and being retained in part by retaining segments 39 and 40.

As will also be apparent, in view of the earlier discussion concerning the FIGS. 5–11 embodiment, appropriate, selectively actuatable, detachable tie-down or latching means may be employed to secure the rail means 43 to the channel means 44, or otherwise secure the upper end 7 of the jacket 1 to the upper fixed portion of the barge 4, to the left of pivot shoe means 37 during the towing operation. Such detachable tie-down or coupling means would be released prior to the initiation of the launching means.

As will also be apparent in view of FIG. 13(*a*), two or more rail means 43 may be provided so as to provide plural support means underlying side 16 of the upper end 7 of jacket 1. Preferably, pivot shoe means 37 would define a jacket supporting continuation of each channel means 44.

With the arrangement described in FIGS. 13(*a*)–13(*c*), and with the tie-down mechanism released between the jacket top 7 and the stationary upper portion of the barge 4, the jacket 1 is free to pivot about the pivot axis 34(*a*) during the launching operation while remaining slideably retained by the pivot shoe means 37. This arrangement provides a pendulum-like engagement between the jacket upper end 7 and the barge 4, but permits the jacket to slide through segment means 39 and 40 to a stabilized, buoyancy determined position in the water.

Having described the modified pivot facilitating and jacket retaining pivot shoe means 37, it is now appropriate to give consideration to the sequences of steps involved in the modified jacket launching technique illustrated in FIGS. 12–15.

FIG. 12 illustrates the step in this alternative launching procedure at the point in time where the procedure commences to differ from the overall procedure described in FIGS. 5–11.

As shown in FIG. 12, the lower jacket end 6 has moved free of the aft barge 5 and started to descend downwardly through the water body 45, beneath the water surface 46.

Thus, this point in the sequence corresponds generally to that feature in FIG. 8 of the first preferred launching sequence.

However, it will here be appreciated that during the movement of the lower jacket end 6 off of the aft barge 5, while the upper jacket end 7 is free to pivot upwardly away from and across the upper surface of the barge 4, generally toward the other barge 5, the pivot shoe means 37 remains retainingly engaged with the jacket top 7 via rail means 43, although the rail means can slide through socket means 37*a*. (in FIG. 8, jacket top 7 is free to separate from shoe 32 as the jacket top rotates away from barge 4).

As a result of the slidable but jacket retaining interaction between the pivot shoe means 37 and the jacket top 7, the jacket 1 will swing clockwise as shown in FIGS. 13–14 consecutively through a generally horizontal position downwardly to the generally upright configuration depicted in FIG. 14, and probably undergo some sliding movement off barge 4, through pivot shoe means 37.

Throughout this clockwise pivotal sequence, where the jacket moves sequentially through the FIGS. 12–14 positions, the pivot shoe means 37 remains engaged with the upper jacket end 7 so as to provide a pendulum-like control over the jacket, uprighting operations.

After the jacket 1 has been ballasted at its lower end so as to assume the FIG. 14, substantially upright configuration, the clamping means 42 may be released so as to permit the clamp segment means 39 and 40 to be removed, and thus free jacket end 7 from barge 4. Such release may be manually or automatically effected, depending upon the nature of the clamping means 42.

Alternatively, rail means 43 may be sufficiently short that they will slide below and free of pivot shoe means 37 during the lowering of jacket 1, downwardly from the position depicted in FIG. 14. By way of a further alternative, the jacket 1 may be slideably retained in the pivot shoe 37 of barge 4 until the jacket is settled on the bottom and sufficiently ballasted as to be secured against movement.

In any event, once the jacket 1 has assumed a stable upright position, it may be further ballasted at its lower end, to cause it to settle downwardly through water body 45. FIG. 15 depicts the separated jacket 1 free of the barge 4, and settled on the submerged surface 35 as a result of appropriate ballasting.

As will be appreciated, the jacket retaining means associated with pivot shoe means 37 may assume a variety of configurations, with the separable, rail retaining segment embodiment featured in FIGS. 13(*b*) and 13(*c*) having been illustrated by way of example only. It will further be appreciated that, where appropriate, segments such as 39 andd 40 may actually clampingly engage rail means 43 during at least selected portions of the launching operation and enable barge 4 to buoyantly support the upper jacket end. Releasing of such clamps would permit an upright, negatively buoyant jacket to descend.

With each of the two alternative preferred launching techniques having been described in connection with the jacket 1, brief comments are now in order in relation to techniques which might be employed to appropriately stabilize and position the jacket 1 in preparation for the final jacket setting operation.

Final Jacket Setting and Positioning

FIGS. 16–18 illustrate jacket manipulating techniques which may be employed to control the final positioning of the jacket 1, after the jacket 1 has been freed from supporting engagement with the support barge means 4 and 5.

As schematically shown in FIGS. 16 and 17, vessels 47 and 48 may be detachably connected with jacket 1 by way of appropriate cable or tether means 49 and 50. As is depicted on FIG. 17, each of the tether means 49 and 50 may involve cross cable arrangements extending between the vessels 47 and 48 and the upper end 7 of the jacket 1, Preferably, vessels 47 and 48 would be moored, i. e. anchored in desired positions. Alternatively, barge 4 of FIG. 14 may be slideably retained in relation to the jacket and itself be moored to provide positioning means for jacket 1.

With the buoyant (i.e. not settled to the submerged surface) jacket 1 tethered between vessels 47 and 48, the jacket 1 may be laterally manipulated, if desired, (by way of tether control) to a desired final position before ballasting is completed so as to lower the jacket 1 to its final resting place on submerged surface 37. In any event, the tether system should control lateral jacket positioning, with the tether lines being tightened and/or loosened as required and appropriate ballast control being maintained.

Once the jacket 1 has been finally positioned on the submerged surface 35, an appropriate pile driving vessel 51 may be moved into position so as to drive piling 52 through the jacket leg means 53 and complete the anchoring of the jacket 1 to the submerged surface 35. Thereafter, appropriate derrick barge means may be brought into position (or the pile driving barge may be employed) to complete the installation of deck equipment, etc. so as to provide a completed offshore platform installation.

At this juncture, with individual aspects of the invention having been described in detail, it is appropriate to summarize those aspects of the invention which are believed to constitute particularly significant, novel and advantageous aspects of the invention.

SUMMARY OF OVERALL NOVEL METHOD ASPECTS OF INVENTION

In relation to the basic method concept herein presented, the present invention may be summarized as follows, this summary taking into account the variations in practicing the invention which are hereafter discussed.

A method is provided for transporting an offshore tower 1 to an offshore site and erecting this tower 1 to a generally upright position on a submerged surface 35. This method comprises the steps of:

A. supporting one end (6 or 7) of the tower 1 on a first parge (4 or 5);
B. supporting the other end (6 or 7) of the tower 1 on a second barge (4 or 5);
C. towing the barges (4 and 5) and tower 1 to an offshore site;
D. launching the tower 1 from the barges (4 and 5) by
  i. mutually separating the first and second barges (4 and 5) by applying substantially horizontal and oppositely directed forces to the first barge (4 or 5) and tower 1,
  ii. slidably displacing the one tower end (6 or 7) and the first barge (4 or 5) in response to the separating noted above, whereby the one tower end (6 or 7) slides across the first barge (4 or 5) into the water, while maintaining the other tower end (6 or 7) supported on the second barge (4 or 5),
  iii. causing the other end (6 or 7) of the tower 1 to be displaced across the second barge (4 or 5) to the side thereof, and
  iv. separating the other tower end (6 or 7) from the second barge (4 or 5);
E. maintaining the first barge (4 or 5) and second barge (4 or 5) substantially upright during the aforesaid launching; and
F. causing the tower 1, while separated from at least one barge (4 or 5) to settle to an upright position on a submerged surface.

Other, independently significant method facets of the invention, which may be employed in the context of the basic method invention noted above, may be summarized as follows.

A method facet, relating to a preferable towing and launching techique comprises a method wherein:

the tower 1 includes
  a relatively large base end 6 comprising the aforesaid one tower end, and
  a relatively small top end 7 comprising the aforesaid other tower end;
the barge 4 supporting the relatively small tower end 7 is towed by vessel means (11,12) to effect the aforesaid towing;
during the slidable displacing of the relatively large tower end 6 and the first barge 5,
  the relatively small tower end 7 pivots upwardly, away from and across the second barge 4 so as to become displaced relatively thereto; and
during the towing noted above, the tower 1 is supported on the first and second barges (4 and 5) with its longitudinal axis extending transversely of the longitudinal axes of barges (4 and 5).

Another method facet, pertaining to the use of pivot shoe type launch means, comprises a method wherein:

at least one (6 or 7) of the one and other ends (6 and 7) of the tower 1 is at least in part supported on its supporting barge (4 or 5) by
  pivotable support means (32 or 37), pivotably mounted on its supporting barge (4 or 5) and slidably supporting the aforesaid one (6 or 7) of the tower ends (6 and 7); and
during the jacket launching,
  the pivotable support means (32 or 37), while slidably supporting the aforesaid one (6 or 7) of the ends (6 and 7) of the tower 1, pivots about a side of its supporting barge so as to pivot the aforesaid one (6 or 7) of tower ends (6 and 7) away from and across its supporting barge (4 or 5) and toward the other barge (4 or 5), and
  the one (6 or 7) of the ends (6 and 7) of the tower undergoes sliding movement relative to and across the pivotable support means (32 or 37).

In relation to the skid-launch aspect of the invention, a method facet is presented, wherein:

at least one (6 or 7) of the one and other ends (6 and 7) of the tower 1 is at least in part supported on its supporting barge (4 or 5) by
  slide means 22, carried by the tower 1, and slidably resting on skid means 18 carrid by the supporting barge (4 or 5); and
during the jacket launching,
  the slide means 22, carried by the one (6 or 7) of the tower ends (6 and 7), slides off of the skid means 18 across one side of its supporting barge (4 or 5), with the supporting barge (4 or 5) moving away from the other barge (4 or 5).

Finally, with respect to the "pendulum" launching technique, a method is contemplated which wherein:

at least one (6 or 7) of the one and other ends (6 and 7) of the tower 1 is at least in part supported on its supporting barge (4 or 5) by
  pivotable support means 37 pivotably mounted on its supporting barge (4 or 5); and
during the jacket launching,
  the pivotable support means 37, while supporting the one (6 or 7) of the ends (6 and 7) of the tower 1, pivots about a side of its supporting barge (4 or 5) so as to pivot the one (6 or 7) of the tower ends (6 and 7) away from and across its supporting barge (4 or 5) and toward the other barge (4 or 5), and
  the pivotable support means 37 remains engaged with the tower 1 while the tower pivots to a generally upright buoyant condition.

SUMMARY OF MAJOR ADVANTAGES, MODIFICATIONS, UNOBVIOUSNESS, AND OVERALL SCOPE OF INVENTION

A major advantage of the invention resides in the manner in which generally conventionally sized barge structures may be employed to handle the launching of large, fully assembled jacket structures required for deep water operation.

Further collateral advantages of the invention pertain to the safety, stability and efficiency of jacket launching operations as described in connection with the two alternative preferred embodiments.

Significantly, these advantages are achieved without employing massive barge or auxiliary buoyancy structures and without requiring reliance upon fabrication of jacket structures or assembly of jacket sections at offshore installation sites.

While the invention has been described with reference to preferred embodiments, it will be apparent at this juncture that significant variations may be practiced in relation to the techniques which have been illustrated hereinbefore by way of example.

For example, under appropriate conditions, the assembly 10 may be towed by the barge 5 or the assembly 10 may be towed in the longitudinal direction of the barges 4 and 5 by tug means or other vessel means connected by tow line means to the ends of the barge means 4 and 5.

With respect to the jacket launching operation, it will be apparent that under certain circumstances it may be feasible to launch the upper jacket end 7 before the lower jacket end 6 is launched.

It will also be recognized that skid and slide means (i.e. any combination of skid means or rails), may be employed on either or each of the barge means 4 and 5 for launching jacket ends or that tilt or pivot mechanisms may be employed at either or each barge for jacket end launching or that a skid and slide arrangements may be employed at either barge for such launching with a pivot means being employed at the other barge (it here being understood that in any embodiment as hereinbefore noted, the pivot shoe means may or may not perform a jacket retaining action as described in connection with the "pendulum" embodiment).

It will also be recognized that any skid and slide means may involve the use of friction reducing belts and/or rollers, etc. Thus, the term "sliding" as used in this disclosure is embracive of forms of relative translation between contiguous members where friction reducing means are interposed between the relatively translating members.

In connection with the initial jacket end launching, which is achieved by relative separation of the jacket supporting barges, generally horizontal force applying means other than the hydraulic pusher assembly means featured in FIGS. 6(*b*)–6(*e*) may be employed. Indeed, under appropriate circumstances, it may be feasible to exert a pulling force on one barge 4, external of the assembly 10, so as to effect barge separation. Such external pulling forces could be employed, for example, by appropriate anchor means, extenal service vessel means, etc. Whatever mode of force application is employed, it will be appreciated that the term "horizontal" is embracive of all forces which include a significant horizontal component.

It will also be recognized that, in general, the movement of the jacket off of the two barges will be generally smooth and continuous in nature and may entail appropriate preballast control and/or manual and/or automatic ballast adjustments during launching.

As to relationships between moments of buoyancy and weight about the last barge that the jacket is freed from, it will be appreciated that at the commencement of launching, the moment of the jacket weight will exceed the moment of buoyancy. While the moment of buoyancy will increase, as the jacket begins to submerge at its first freed end, unless it is intended to initially arrest downward pivoted movement of the jacket by buoyancy control, the total moment of weight of the jacket plus any jacket ballast will prevail and induce a continuous launch operation, at least to the point where the jacket becomes upright. It will be understood that a stable upright floating position of the jacket is secured by appropriate control of the locations of the center of gravity and center of buoyancy, since the total weight of the jacket and its ballast cannot be greater than the available buoyancy when the jacket is upright and floating.

Furthermore, because of the natural barge heeling tendencies, earlier noted, heeling of the second-to-be-freed barge will probably precede the pivoting of the second-to-be-launched jacket end across the top of this barge.

The unobviousness of the present inventive concept is attested to by the general state of the prior art as exemplified by patents such as those noted at the outset of this disclosure.

Where the prior art relied upon segmental assembly, submergable buoyancy units, detachable auxiliary buoyancy means, outrigger supports, or rotary buoyancy units in order to achieve jacket launching and/or erection, the present invention departs from such concepts and provides a significantly simplified technique enabling the utilization of conventional barge structures to achieve safe and reliable launching of large jackets (or indeed jackets of any size).

Those skilled in the offshore art, and familiar with this disclosure may recognize additions, deletions, substitutions, modifications, equivalent concepts, and other arrangements in addition to the manipulative techniques herein disclosed which would fall within the purview of the invention as set forth in the appended claims.

We claim:

1. A method for transporting an offshore tower to an offshore site and erecting said tower to a generally upright position on a submerged surface, said method comprising the steps of:

supporting one end of said tower on first barge means;

supporting the other end of said tower on second barge means;

towing said barge means and tower to an offshore site;

launching said tower from said barge means by mutually separating said first and second barge means by applying substantially horizontal and oppositely directed forces to said first barge and tower, slidably displacing said one tower end and said first barge means in response to said separating, whereby said one tower end slides across said first barge means into the water, while maintaining said other tower end supported on said second barge means, separating said first barge means from supporting engagement with said one tower end;

causing the other end of said tower to be displaced across said second barge means to the side thereof, and separating said other tower end from said second barge means;

maintaining said first barge means and second barge means substantially upright during said launching; and causing said tower, while separated from supporting engagement with at least said first barge means, to settle to an upright position on a submerged surface;

said separating of said first barge means from supporting engagement with said one tower end being operable to heel said first barge means and displace said first barge means from said second barge means and said one tower end.

2. A method as described in claim 1 wherein: said tower includes a relatively large base end comprising said one tower end, and a relatively small top end comprising said other tower end, said barge means supporting said relatively small tower end is towed by vessel means to effect said towing;

during said slidable displacing of said relatively large tower end and said first barge means, said relatively small tower end pivots upwardly, away from and across said second barge means so as to become displaced relatively thereto; and during said towing, said tower is supported on said first and second barge means with its longitudinal axis extending transversely of the longitudinal axes of said barges.

3. A method for transporting an offshore tower to an offshore site and erecting said tower to a generally upright position on a submerged surface, said method comprising the steps of:

supporting one end of said tower on first barge means;

supporting the other end of said tower on second barge means;

towing said barge means and tower to an offshore site;

launching said tower from said barge means by mutually separating said first and second barge means by applying substantially horizontal and oppositely directed forces to said first barge means and tower, slidably displacing said one tower end and said first barge means in response to said separating, whereby said one tower end slides across said first barge means into the water, while maintaining said other tower end supported on said second barge means, causing the other end of said tower to be displaced across said second barge means to the side thereof, and separating said other tower end from said second barge means;

maintaining said first barge means and second barge means substantially upright during said launching; and causing said tower, while separated from at least said first barge means, to settle to an upright position on a submerged surface;

at least one of said one and other ends of said tower being at least in part supported on its supporting barge means by pivotable support means, pivotably mounted on said supporting barge and slidably supporting said one of said tower ends; and during said launching, said pivotable support means, while slidably supporting said one of said ends of said tower, pivots about a side of said supporting barge means so as to pivot said one of said ends away from and across said supporting barge means and toward said other barge means, and said one of said ends of said tower undergoes sliding movement relative to, and across, said pivotable support means.

4. A method for transporting an offshore tower to an offshore site and erecting said tower to a generally upright position on a submerged surface, said method comprising the steps of:

supporting one end of said tower on first barge means;

supporting the other end of said tower on second barge means;

towing said barge means and tower to an offshore site;

launching said tower from said barge means by mutually separating said first and second barge means by applying substantially horizontal and oppositely directed forces to said first barge means and tower, slidably displacing said one tower end and said first barge means in response to said separating, whereby said one tower end slides across said first barge means into the water, while maintaining said other tower end supported on said second barge means, causing the other end of said tower to be displaced across said second barge means to the side thereof, and separating said other tower end from said second barge means;

maintaining said first barge means and second barge means substantially upright during said launching; and causing said tower, while separated from at least said first barge means, to settle to an upright position on a submerged surface;

at least one of said one and other ends of said tower being at least in part supported on its supporting barge means by slide means, carried by said tower, and slidably resting on skid means carried by said supporting barge means; and during said launching, said slide means, carried by said one of said tower ends, slides off of said skid means across one side of said supporting barge means, with said supporting barge means moving away from said other barge means.

5. A method for transporting an offshore tower to an offshore site and erecting said tower to a generally upright position on a submerged surface, said method comprising the steps of:

supporting one end of said tower on first barge means;

supporting the other end of said tower on second barge means;

towing said barge means and tower to an offshore site;

launching said tower from said barge means by mutually separating said first and second barge means by applying substantially horizontal and oppositely directed forces to said first barge means and tower, slidably displacing said one tower end and said first barge means in response to said separating, whereby said one tower end slides across said first barge means into the water, while maintaining said other tower end supported on said second barge means, causing the other end of said tower to be displaced across said second barge means to the side thereof, and separating said other tower end from said second barge means;

maintaining said first barge means and second barge means substantially upright during said launching; and causing said tower, while separated from at least said first barge means, to settle to an upright position on a submerged surface;

at least one of said one and other ends of said tower being at least in part supported on its supporting barge means by pivotable support means pivotably mounted on said supporting barge means; and during said launching, said pivotable support means, while supporting said one of said end of said tower, pivots about a side of said supporting barge means so as to pivot said one of said tower ends away from and across said supporting barge means and toward said other barge, and said pivotable support means remains engaged with said tower while said tower pivots to a generally upright buoyant condition.

6. A method for transporting an offshore tower to an offshore site and erecting said tower to a generally upright position on a submerged surface, said method comprising the steps of:

supporting one end of said tower on first barge means;

supporting the other end of said tower on second barge means;

towing said barge means and tower to an offshore site;

launching said tower from said barge means by mutually separating said first and second barge means by applying substantially horizontal and oppositely directed forces to said first barge means and tower, slidably displacing said one tower end and said first barge means in response to said separating, whereby said one tower end slides across said first barge means into the water, while maintaining said other tower end supported on said second barge means, causing the other end of said tower to be displaced across said second barge means to the side thereof, and separating said other tower end from said second barge means;

maintaining said first barge means and second barge means substantially upright during said launching; and causing said tower, while separated from at least said first barge means, to settle to an upright position on a submerged surface;

said tower including a relatively large base end comprising said one tower end, and a relatively small top end comprising said other tower end;

said barge means supporting said relatively small tower end being towed by vessel means to effect said towing;

during said slidable displacing of said relatively large tower end and said first barge means, said relatively small tower end pivots upwardly, away from and across said second barge means so as to become displaced relatively thereto;

during said towing, said tower is supported on said first and second barge means with its longitudinal axis extending transversely of the longitudinal axes of said barge means;

at least one of said one and other ends of said tower being at least in part supported on its supporting barge means by pivotable support means, pivotably mounted on said supporting barge means and slidably supporting said one of said tower ends; and during said launching, said pivotable support means, while slidably supporting said one of said ends of said tower, pivots about a side of said supporting barge means so as to pivot said one of said ends away from and across said supporting barge means and toward said other barge means, and said one of said ends of said tower undergoes sliding movement relative to, and across, said pivotable support means.

7. A method for transporting an offshore tower to an offshore site and erecting said tower to a generally upright position on a submerged surface, said method comprising the steps of:

supporting one end of said tower on first barge means;

supporting the other end of said tower on second barge means;

towing said barge means and tower to an offshore site;

launching said tower from said barge means by mutually separating said first and second barge means by applying substantially horizontal and oppositely directed forces to said first barge means and tower, slidably displacing said one tower end and said first barge means in response to said separating, whereby said one tower end slides across said first barge means into the water, while maintaining said other tower end supported on said second barge means, causing the other end of said tower to be displaced across said second barge means to the side thereof, and separating said other tower end from said second barge means;

maintaining said first barge means and second barge means substantially upright during said launching; and causing said tower, while separated from at least said first barge means, to settle to an upright position on a submerged surface;

said tower including a relatively large base end comprising said one tower end, and a relatively small top end comprising said other tower end;

said barge means supporting said relatively small tower end being towed by vessel means to effect said towing;

during said slidable displacing of said relatively large tower end and said first barge means, said relatively small tower end pivots upwardly, away from and across said second barge means so as to become displaced relatively thereto;

during said towing, said tower is supported on said first and second barge means with its longitudinal axis extending transversely of the longitudinal axes of said barge means;

at least one of said one and other ends of said tower being at least in part supported on its supporting barge means by slide means, carried by said tower, and slidably resting on skid means carried by said supporting barge means; and during said launching, said slide means, carried by said one of said tower ends, slides off of said skid means across one side of said supporting barge means, with said supporting barge means moving away from said other barge means.

8. A method for transporting an offshore tower to an offshore site and erecting said tower to a generally upright position on a submerged surface, said method comprising the steps of:

supporting one end of said tower on first barge means;

supporting the other end of said tower on second barge means;

towing said barge means and tower to an offshore site;

launching said tower from said barge means by mutually separating said first and second barge means by applying substantially horizontal and oppositely directed forces to said first barge means and tower, slidably displacing said one tower end and said first barge means in response to said separating, whereby said one tower end slides across said first barge means into the water, while maintaining said other tower end supported on said second barge means, causing the other end of said tower to be displaced across said second barge means to the side thereof, and separating said other tower end from said second barge means;

maintaining said first barge means and second barge means substantially upright during said launching; and causing said tower, while separated from at least said first barge means, to settle to an upright position on a submerged surface;

said tower including a relatively large base end comprising said one tower end, and a relatively small top end comprising said other tower end, said barge means supporting said relatively small tower end being towed by vessel means to effect said towing;

during said slidable displacing of said relatively large tower end and said first barge means, said relatively small tower end pivots upwardly, away from and across said second barge means so as to become displaced relatively thereto;

during said towing, said tower is supported on said first and second barge means with its longitudinal axis extending transversely of the longitudinal axes of said barge means;

said relatively large base end of said tower being at least in part supported on said first barge means by slide means, carried by said tower, and slidably resting on skid means carried by said first barge means;

during said launching, said slide means, carried by said relatively large base end of said tower, slides off of said skid means across one side of said first barge means, with said first barge means moving away from said second barge means;

said relatively small top end of said tower being at least in part supported on said second barge means by pivotable support means, pivotably mounted on said second barge means and slidably supporting said relatively small top tower end; and during said launching, said pivotable support means, while slidably supporting said relatively small tower top end, pivots about a side of said second barge means so as to pivot said relatively small tower top end away from and across said second barge means and toward said first barge means, and said relatively small tower top end undergoes sliding movement relative to and across said pivotable support means.

9. A method for transporting an offshore tower to an offshore site and erecting said tower to a generally upright position on a submerged surface, said method comprising the steps of:

supporting one end of said tower on first barge means;

supporting the other end of said tower on second barge means;

towing said barge means and tower to an offshore site;

launching said tower from said barge means by mutually separating said first and second barge means by applying substantially horizontal and oppositely directed forces to said first barge means and tower, slidably displacing said one tower end and said first barge means in response to said separating, whereby said one tower end slides across said first barge means into the water, while maintaining said other tower end supported on said second barge means, causing the other end of said tower to be displaced across said second barge means to the side thereof, and separating said other tower end from said second barge means; maintaining said first barge means and second barge means substantially upright during said launching; and causing said tower, while separated from at least said first barge means, to settle to an upright position on a submerged surface;

said tower including a relatively large base end comprising said one tower end, and a relatively small top end comprising said other tower end, said barge means supporting said relatively small tower end being towed by vessel means to effect said towing;

during said slidable displacing of said relatively large tower end and said first barge means, said relatively small tower end pivots upwardly, away from and across said second barge means so as to become displaced relatively thereto;

during said towing, said tower is supported on said first and second barge means with its longitudinal axis extending transversely of the longitudinal axes of said barge means;

at least one of said one and other ends of said tower being at least in part supported on its supporting barge means by pivotable support means pivotably mounted on said supporting barge means; and during said launching, said pivotable support means, while supporting said one of said end of said tower, pivots about a side of said supporting barge means so as to pivot said one of said tower ends away from and across said supporting barge means and toward said other barge means, and said pivotable support means remains engaged with said tower while said tower pivots to a generally upright buoyant condition.

10. A method for transporting an offshore tower to an offshore site and erecting said tower to a generally upright position on a submerged surface, said method comprising the steps of:

supporting one end of said tower on first barge means;

supporting the other end of said tower on second barge means;

towing said barge means and tower to an offshore site;

launching said tower from said barge means by mutually separating said first and second barge means by applying substantially horizontal and oppositely directed forces to said first barge means and tower, slidably displacing said one tower end and said first barge means in response to said separating, whereby said one tower end slides across said first barge means into the water, while maintaining said other tower end supported on said second barge means, causing the other end of said tower to be displaced across said second barge means to the side thereof, and separating said other tower end from said second barge means;

maintaining said first means and second barge means substantially upright during said launching; and causing said tower, while separated from at least said first barge means, to settle to an upright position on a submerged surface;

said tower including a relatively large base end comprising said one tower end, and a relatively small top end comprising said other tower end, said barge means supporting said relatively small tower end being towed by vessel means to effect said towing;

during said slidable displacing of said relatively large tower end said first barge means, said relatively small tower end pivots upwardly, away from and across said second barge means so as to become displaced relatively thereto;

during said towing, said tower is supported on said first and second barge means with its longitudinal axis extending transversely of the longitudinal axes of said barge means;

said relatively large base end of said tower being at least in part supported on said first barge means by slide means, carried by said tower, and slidably resting on skid means carried by said first barge means;

during said launching, said slide means, carried by said relatively large base end of said tower, slides off of said skid means across one side of said first barge means, with said first barge means moving away from said second barge means;

said relatively small top end of said tower being at least in part supported on said second barge means by pivotable support means pivotably mounted on said second barge means; and during said launching;

said pivotable support means, while supporting said relatively small top end of said tower, pivots about a side of said second barge means so as to pivot said relatively small top end of said tower away from and across said second barge means and toward said first barge means, and said pivotable support means remains engaged with said tower while said tower pivots to a generally upright buoyant condition.

* * * * *